US007832026B1

(12) United States Patent
Bryant et al.

(10) Patent No.: US 7,832,026 B1
(45) Date of Patent: Nov. 16, 2010

(54) TOILET ACTUATION APPARATUS

(76) Inventors: Rose N. Bryant, 4800 Sanoma VLG., Orlando, FL (US) 32808; Cedric Ladouceur, 119 Meadow Lark Dr., Altamonte Springs, FL (US) 32701

( * ) Notice: Subject to any disclaimer, the term of this patent is extended or adjusted under 35 U.S.C. 154(b) by 643 days.

(21) Appl. No.: 11/860,731

(22) Filed: Sep. 25, 2007

(51) Int. Cl.
*A47K 13/10* (2006.01)

(52) U.S. Cl. ..... 4/246.3; 4/246.1

(58) Field of Classification Search ..... 4/246.1–246.5, 4/248–250

See application file for complete search history.

(56) References Cited

U.S. PATENT DOCUMENTS 4,578,830 A * 4/1986 Chuang ..... 4/246.3
4,807,307 A * 2/1989 Sato et al. ..... 4/246.4
5,056,165 A * 10/1991 Wescott, Sr. ..... 4/246.1
5,103,506 A * 4/1992 Munford et al. ..... 4/246.4
5,339,468 A * 8/1994 Lin ..... 4/246.5
5,444,877 A * 8/1995 Kumarasurier ..... 4/246.1
6,651,262 B1 * 11/2003 Tinsley ..... 4/246.1
6,915,532 B1 * 7/2005 Mohammed ..... 4/246.1
7,614,356 B2 * 11/2009 Knisely et al. ..... 114/90
2004/0045082 A1 * 3/2004 Marras ..... 4/246.1
2006/0090252 A1 * 5/2006 Pantos et al. ..... 4/246.1
2007/0000036 A1 * 1/2007 Jung ..... 4/246.1

* cited by examiner

*Primary Examiner*—Khoa D Huynh

(57) ABSTRACT

A toilet actuation apparatus. An illustrative embodiment of the apparatus includes a lever support, at least one pedal lever pivotally carried by the lever support, at least one pedal carried by the at least one pedal lever on a first side of the lever support, at least one actuation lever pivotally carried by the at least one pedal lever on a second side of the lever support, at least one toothed actuation rack carried by the at least one actuation lever and at least one toothed actuation pinion engaging the at least one toothed actuation rack.

1 Claim, 5 Drawing Sheets

TOILET ACTUATION APPARATUS

FIELD

The present invention relates to toilets. More particularly, the present invention relates to a toilet actuation apparatus for actuating at least one of a toilet lid, a toilet seat and a flush lever using foot-actuated pedals.

BACKGROUND

A conventional toilet includes a toilet bowl on which is pivotally mounted a toilet seat and a toilet lid. A water tank provided on the toilet bowl includes a typically hand-actuated flush lever. The toilet lid and toilet seat can be selectively raised and lowered manually. Many persons have concerns regarding manual operation of a toilet due to the potential for germ contamination.

SUMMARY

The present invention is generally directed to a toilet actuation apparatus. An illustrative embodiment of the apparatus includes a lever support, at least one pedal lever pivotally carried by the lever support, at least one pedal carried by the at least one pedal lever on a first side of the lever support, at least one actuation lever pivotally carried by the at least one pedal lever on a second side of the lever support, at least one toothed actuation rack carried by the at least one actuation lever and at least one toothed actuation pinion engaging the at least one toothed actuation rack.

BRIEF DESCRIPTION OF THE DRAWINGS

The invention will now be described, by way of example, with reference to the accompanying drawings, in which.

DETAILED DESCRIPTION

Figure 1:
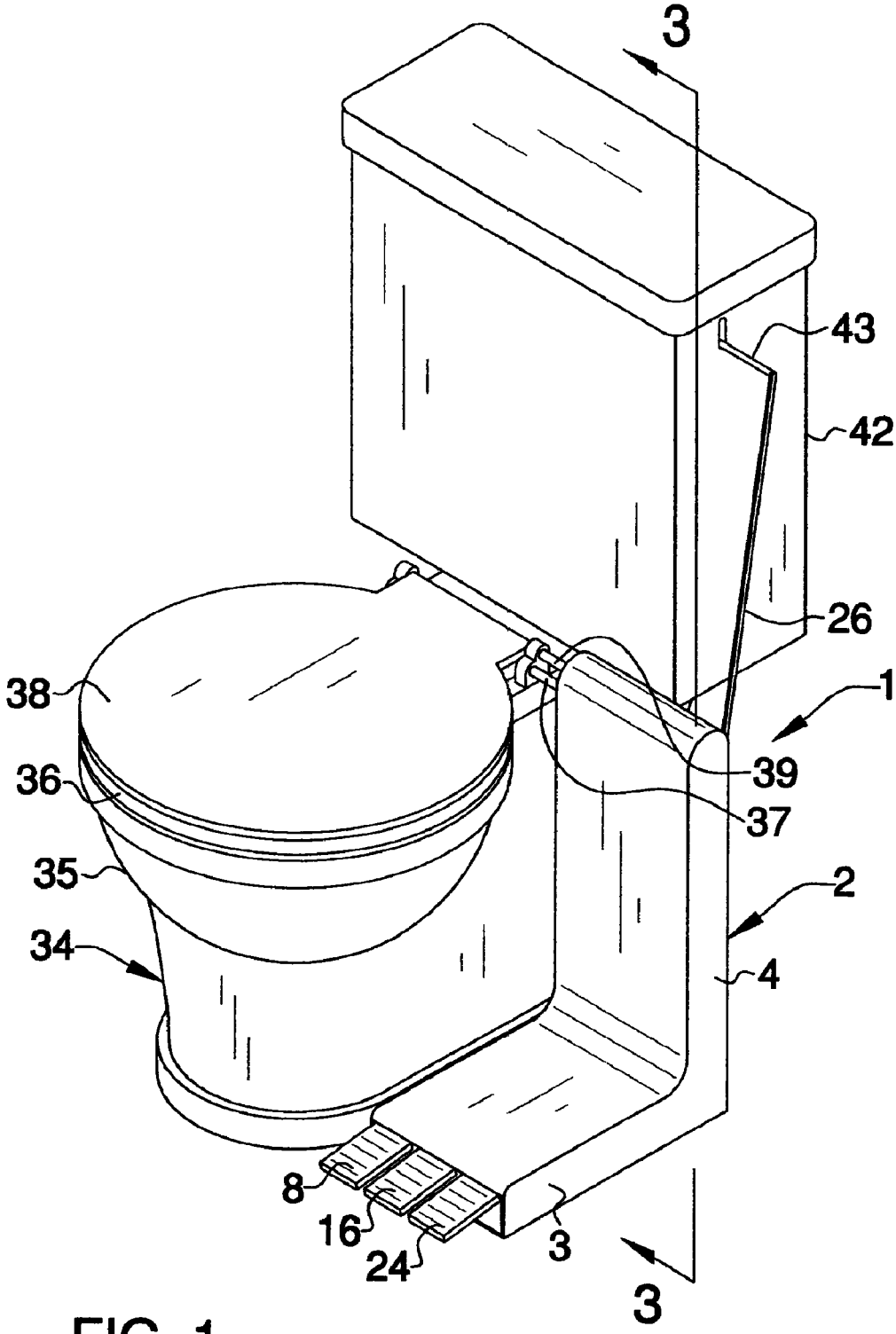
FIG. 1 is a front perspective view of an illustrative embodiment of the toilet actuation apparatus, fitted to a toilet, with the toilet seat and toilet lid shown in a lowered position.

Referring to the drawings, an illustrative embodiment of the toilet actuation apparatus, hereinafter apparatus, is generally indicated by reference numeral 1. As shown in FIGS. 1-4 and will be hereinafter described, the apparatus 1 is adapted to operate a toilet 34 which may be conventional. The toilet 34 typically includes a toilet bowl 35. A toilet seat 36 has a toilet seat axle 37, and a toilet lid 38 has a toilet lid axle 39, which are pivotally attached to the toilet bowl 35. A water tank 42 is provided on the toilet bowl 35 and is fitted with a flush lever 43.

Figure 3:
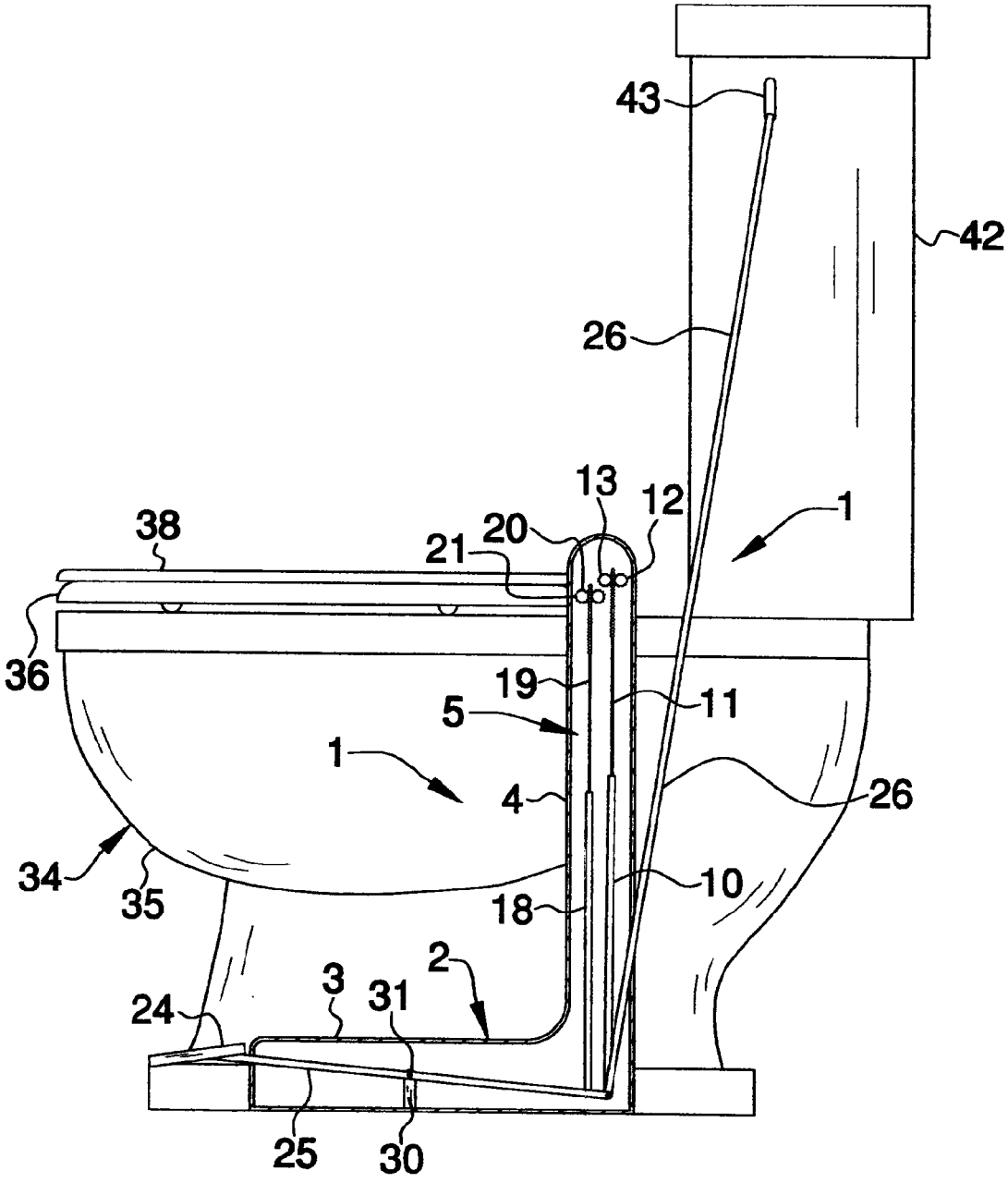
FIG. 3 is a sectional view, taken along section lines 3-3 in FIG. 1.
Figure 4:
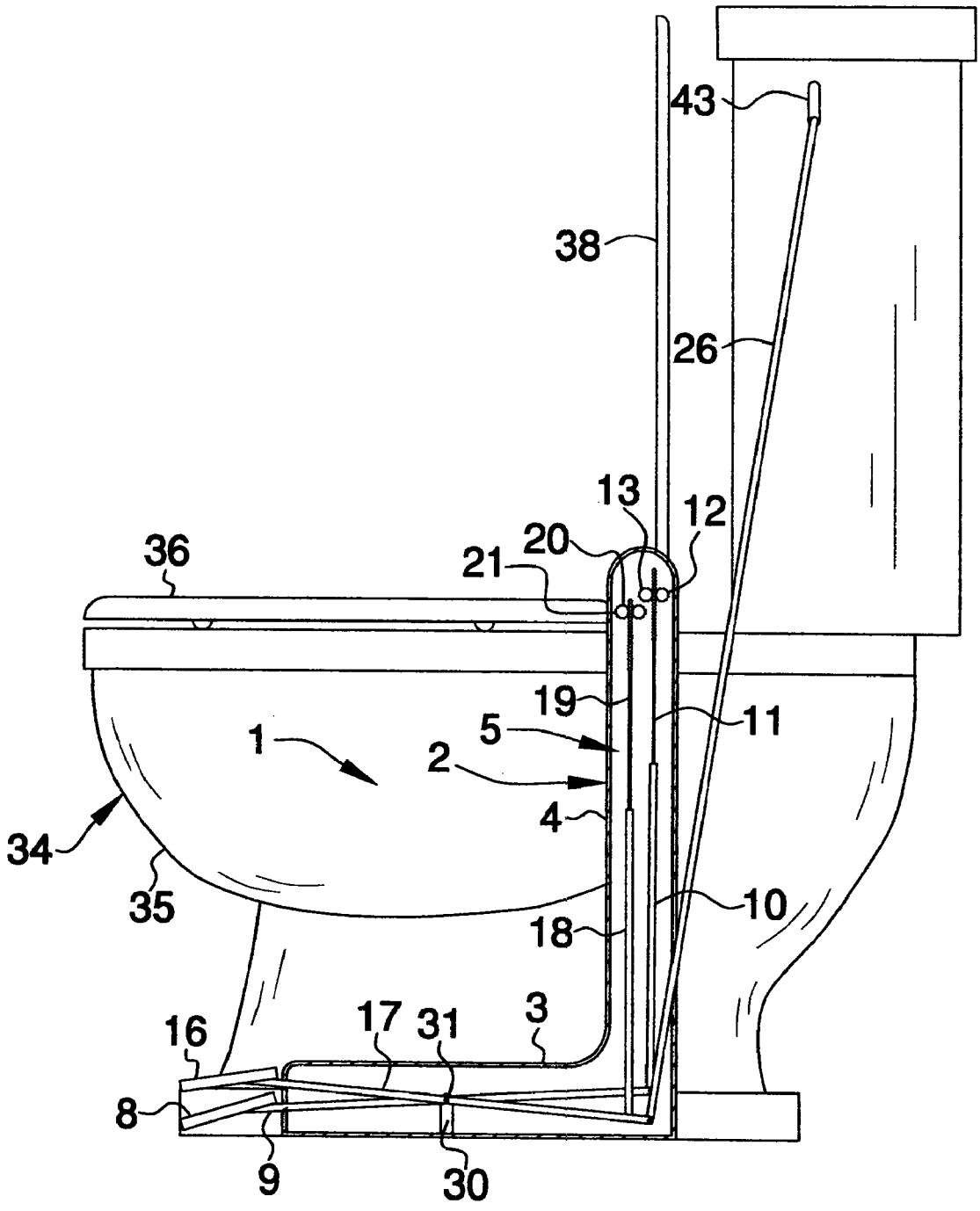
FIG. 4 is a sectional view, taken along section lines 4-4 in FIG. 2.

The apparatus 1 includes an enclosure 2. In some embodiments, the enclosure 2 has a base portion 3 and an extended portion 4 which extends from the base portion 3, in generally perpendicular relationship thereto. As shown in FIGS. 3 and 4, the enclosure 2 has an enclosure interior 5.

Figure 2:
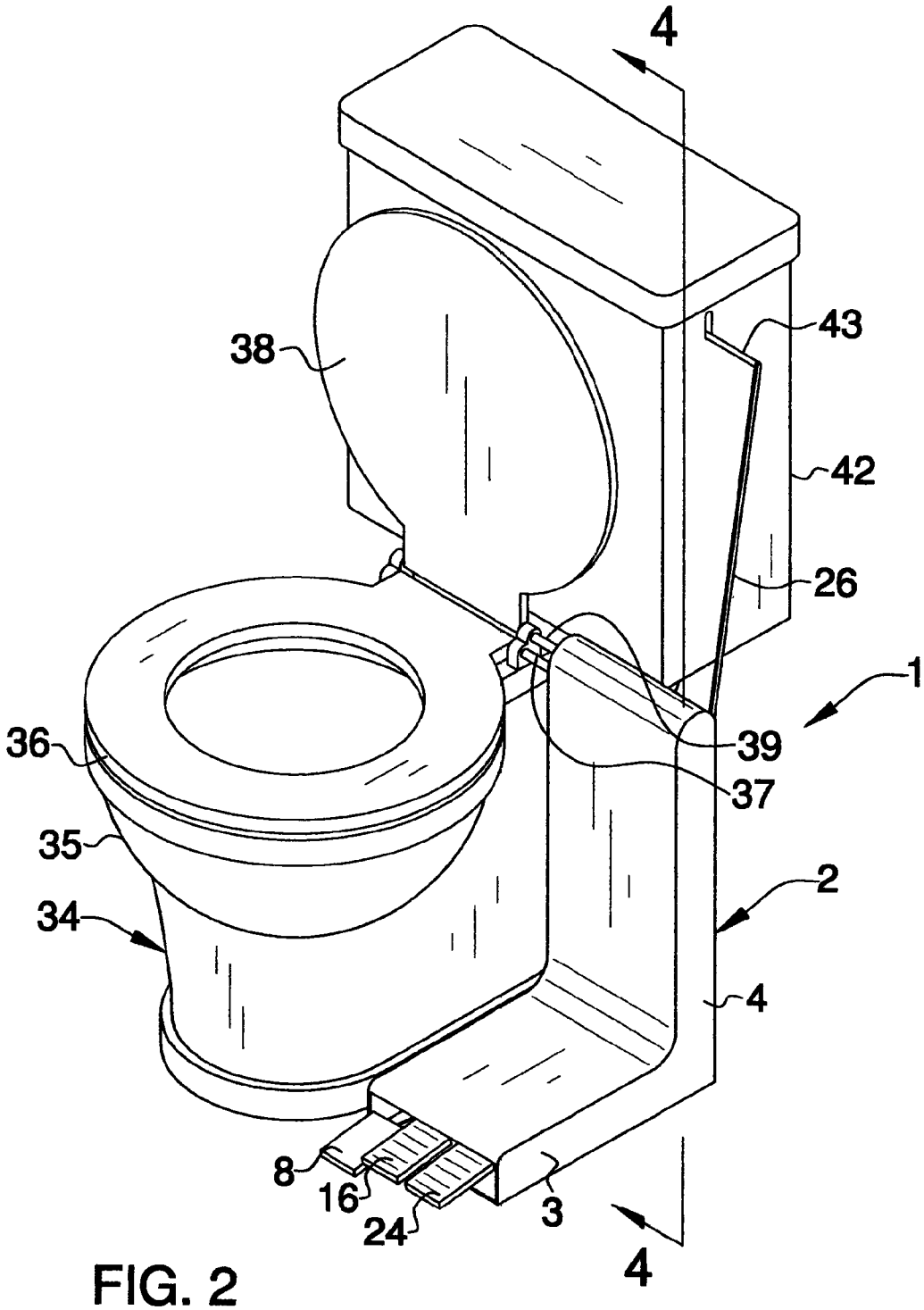
FIG. 2 is a front perspective view of an illustrative embodiment of the toilet actuation apparatus, fitted to a toilet, with the toilet lid shown in a raised position.
Figure 5:
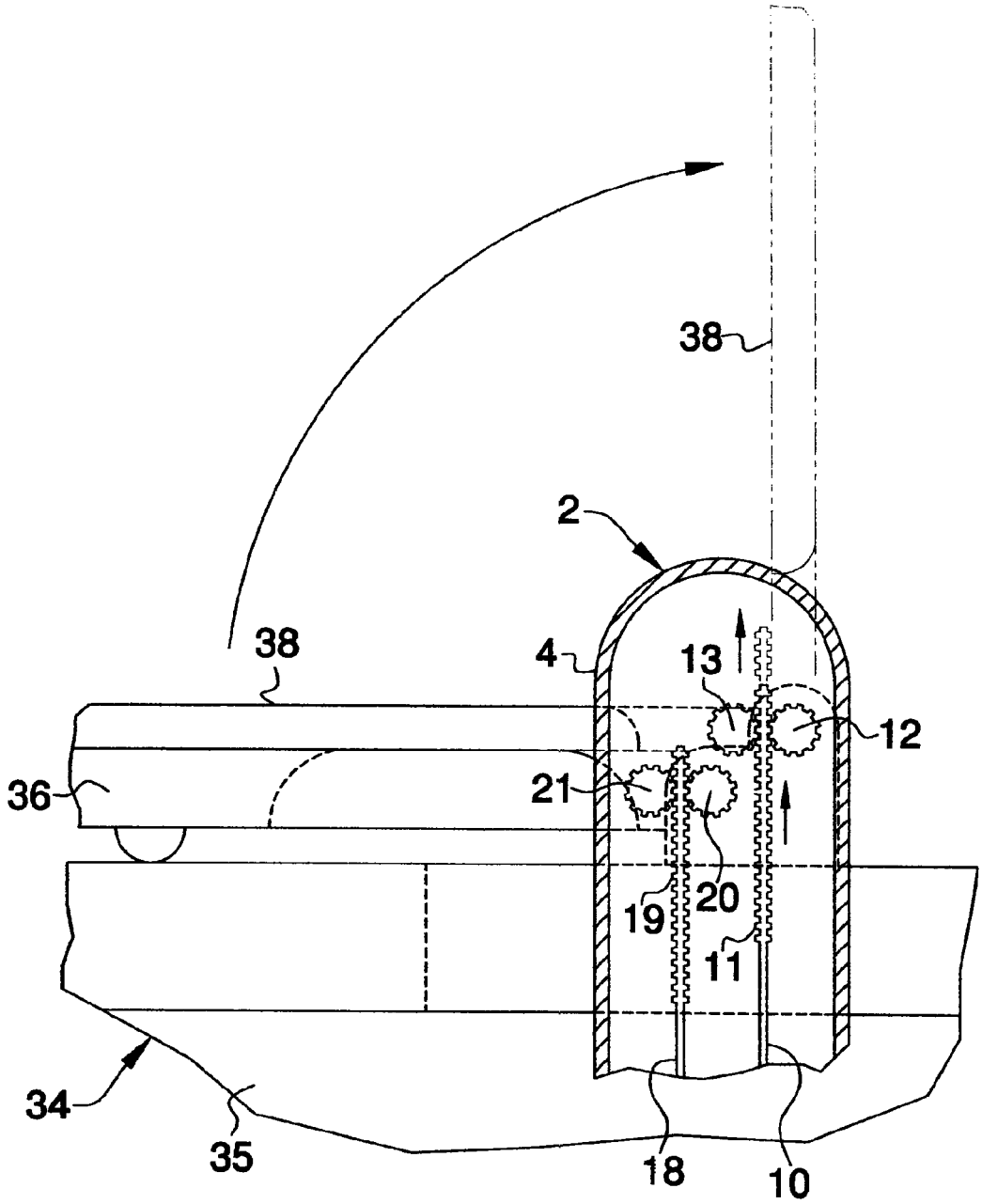
FIG. 5 is a sectional view of an enclosure component of an illustrative embodiment of the toilet actuation apparatus, more particularly illustrating an exemplary technique which facilitates raising and lowering of a toilet seat and toilet lid on the toilet.

As shown in FIGS. 3 and 4, a lever support 30 is provided in the enclosure interior 5 of the base portion 3. As shown in FIG. 4, in some embodiments an elongated lid pedal lever 9 is pivotally attached to the lever support 30 at a pivot point 31. The lid pedal lever 9 extends through a lever slot (not shown) provided in the base portion 3 of the enclosure 2, where a lid pedal 8 is provided on the lid pedal lever 9. As further shown in FIG. 4, an elongated lid actuation lever 10 is pivotally attached to the lid pedal lever 9 and extends through the enclosure interior 5 of the extended portion 4. A toothed lid actuation rack 11 extends from the lid actuation lever 10. As shown in FIG. 5, a toothed lid actuation pinion 12 is provided on the toilet lid axle 39. A toothed lid guide pinion 13 is rotatably attached to the enclosure 2 adjacent to the lid actuation pinion 12. The lid actuation rack 11 extends between and meshes with the lid actuation pinion 12 and the lid guide pinion 13. Accordingly, upon depression of the lid pedal 8, the lid pedal lever 9 (FIG. 4) pivots with respect to the pivot point 31 and raises the lid actuation lever 10 in the enclosure interior 5. The lid actuation rack 11 rotates the lid actuation pinion 12, which in turn rotates the toilet lid axle (FIGS. 1 and 2). This facilitates lifting of the toilet lid 38 from the closed position shown in FIG. 1 to the raised position shown in FIG. 2. Conversely, release of the lid pedal 8 facilitates lowering of the toilet lid 38 back to the closed position in FIG. 1, typically by the falling action of the toilet lid 38, as the lid actuation pinion 12 rotates in the opposite direction; the lid actuation rack 11 is lowered between the lid actuation pinion 12 and the lid guide pinion 13; and the lid pedal lever 9 pivots back to the original position in the enclosure interior 5.

As further shown in FIG. 4, in some embodiments an elongated seat pedal lever 17 is pivotally attached to the lever support 30 at the pivot point 31. The seat pedal lever 17 extends through a lever slot (not shown) provided in the base portion 3 of the enclosure 2, where a seat pedal 16 is provided on the seat pedal lever 17. As further shown in FIG. 4, an elongated seat actuation lever 18 is pivotally attached to the seat pedal lever 17 and extends through the enclosure interior 5 of the extended portion 4. A toothed seat actuation rack 19 extends from the seat actuation lever 18. As shown in FIG. 5, a toothed seat actuation pinion 20 is provided on the toilet seat axle 37. A toothed seat guide pinion 21 is rotatably attached to the enclosure 2 adjacent to the seat actuation pinion 20. The seat actuation rack 19 extends between and meshes with the seat actuation pinion 20 and the seat guide pinion 21. Accordingly, upon depression of the seat pedal 16, the seat pedal lever 17 (FIG. 4) pivots with respect to the pivot point 31 and raises the seat actuation lever 18 in the enclosure interior 5. The seat actuation rack 19 rotates the seat actuation pinion 20, which in turn rotates the toilet seat axle 37 (FIGS. 1 and 2). This facilitates lifting of the toilet seat 36 from the closed position shown in FIG. 4 to a raised position (not shown). Conversely, release of the seat pedal 16 facilitates lowering of the toilet seat 36 back to the closed position, typically by the falling action of the toilet seat 36, as the seat actuation pinion 20 rotates in the opposite direction; the seat actuation rack 19 is lowered between the seat actuation pinion 20 and the seat guide pinion 21; and the seat pedal lever 17 pivots back to the original position in the enclosure interior 5.

As shown in FIG. 3, in some embodiments an elongated flush pedal lever 25 is pivotally attached to the lever support at the pivot point 31. The flush pedal lever 25 extends through a lever slot (not shown) provided in the base portion 3 of the enclosure 2, where a flush pedal 24 is provided on the flush pedal lever 25. As further shown in FIG. 4, an elongated flush actuation lever 26 is pivotally attached to the flush pedal lever 25 and extends from the enclosure interior 5 of the extended portion 4 through a lever slot (not shown). The distal or extending end of the flush actuation lever 26 is attached to the flush lever 43 of the toilet 34 according to the knowledge of those skilled in the art. Accordingly, upon depression of the flush pedal 24, the flush pedal lever 25 pivots with respect to the pivot point 31 and raises the flush actuation lever 26, thereby actuating the flush mechanism (not shown) in the water tank 42. Upon release of the flush pedal 24, the flush pedal lever 25 pivots back to the original position and lowers the flush actuation lever 26.

In typical use of the apparatus 1, the lid pedal 8 is actuated to selectively raise and lower the toilet lid 38; the seat pedal 16 is actuated to selectively raise and lower the toilet seat 36; and the flush pedal 24 is actuated to selectively actuate the flush lever 43 of the toilet 34. This renders unnecessary manual contact of the toilet lid 38, toilet seat 36 and/or flush lever 43 by the user (not shown) of the toilet 34.

While the preferred embodiments of the invention have been described above, it will be recognized and understood that various modifications can be made in the invention and the appended claims are intended to cover all such modifications which may fall within the spirit and scope of the invention.

What is claimed is:

1. A toilet actuation apparatus in combination with a toilet having a water tank, a toilet bowl, a toilet seat and a toilet lid, comprising:

a lever support;

a lid pedal lever and a seat pedal lever pivotally carried by said lever support at a pivot point;

a lid pedal and a seat pedal carried by said lid pedal lever and said seat pedal lever, respectively, on a first side of said lever support;

a lid actuation lever and a seat actuation lever pivotally carried by said lid pedal lever and said seat pedal lever, respectively, on a second side of said lever support;

a toothed lid actuation rack carried by said lid actuation lever and a toothed seat actuation rack carried by said seat actuation lever;

a toothed lid actuation pinion is attached to a toilet lid axle of said toilet lid, said toothed lid actuation pinion engaging said toothed lid actuation rack; and a toothed seat actuation pinion is attached to a toilet seat axle of said toilet seat, said toothed seat actuation pinion engaging said toothed seat actuation rack;

a toothed lid guide pinion positioned adjacent to said toothed lid actuation pinion and a toothed seat guide pinion positioned adjacent to said toothed seat actuation pinion, and wherein said toothed lid actuation rack extends for movement between said toothed lid actuation pinion and said toothed lid guide pinion such that when said lid pedal is depressed, said toothed lid actuation rack raises and rotates said toothed lid actuation pinion which in turn rotates said toilet lid axle to facilitate the lifting of said toilet lid; and wherein said toothed seat actuation rack extends for movement between said toothed seat actuation pinion and said toothed seat guide pinion such that when said seat pedal is depressed, said toothed seat actuation rack raises and rotates said toothed seat actuation pinion which in turn rotates said toilet seat axle to facilitate the lifting of said toilet seat;

a flush pedal lever pivotally carried by said lever support at said pivot point;

a flush pedal carried by said flush pedal lever on a first side of said lever support;

a flush actuation lever pivotally carried by said flush pedal lever on a second side of said lever support, wherein a distal end of said flush actuation lever is attached to a flush lever of said water tank; and an enclosure having an enclosure interior and wherein said lever support, said lid pedal lever, said seat pedal lever, said lid actuation lever, said seat actuation lever, said toothed lid actuation rack, said toothed seat actuation rack, said toothed lid actuation pinion, said toothed seat actuation pinion, said toothed lid guide pinion, said toothed seat guide pinion, and said flush pedal lever are disposed in said enclosure interior, wherein said enclosure comprises a base portion and an extended portion extending from said base portion and wherein said lever support, said lid pedal lever, said seat pedal lever and said flush pedal lever are disposed in said base portion and said lid actuation lever, said seat actuation lever, said toothed lid actuation rack, said toothed seat actuation rack, said toothed lid actuation pinion, said toothed lid guide pinion, said toothed seat actuation pinion, said toothed seat guide pinion and are disposed in said extended portion, wherein said flush actuation lever is extended from the inside to the outside of said extended portion of said enclosure.

* * * * *